US010469952B2

(12) United States Patent
Chen et al.

(10) Patent No.: US 10,469,952 B2
(45) Date of Patent: Nov. 5, 2019

(54) LOUDSPEAKER

(71) Applicant: GOERTEK INC., WeiFeng (CN)

(72) Inventors: Xiaoyuan Chen, WeiFeng (CN); Zhi Li, WeiFeng (CN)

(73) Assignee: GOERTEK INC., Weifang, Shandong (CN)

( * ) Notice: Subject to any disclaimer, the term of this patent is extended or adjusted under 35 U.S.C. 154(b) by 0 days.

(21) Appl. No.: 15/765,331

(22) PCT Filed: Dec. 10, 2015

(86) PCT No.: PCT/CN2015/097008
§ 371 (c)(1),
(2) Date: Apr. 2, 2018

(87) PCT Pub. No.: WO2017/063262
PCT Pub. Date: Apr. 20, 2017

(65) Prior Publication Data

US 2018/0288530 A1 Oct. 4, 2018

(30) Foreign Application Priority Data

Oct. 16, 2015 (CN) ..... 2015 1 0677242

(51) Int. Cl.
*H04R 9/06* (2006.01)
*H04R 9/02* (2006.01)
*H04R 9/04* (2006.01)

(52) U.S. Cl.
CPC ..... *H04R 9/06* (2013.01); *H04R 9/02* (2013.01); *H04R 9/025* (2013.01); *H04R 9/041* (2013.01); *H04R 9/045* (2013.01)

(58) Field of Classification Search
CPC ..... H04R 9/06; H04R 9/025; H04R 9/063; H04R 9/045; H04R 2499/11;
(Continued)

(56) References Cited

U.S. PATENT DOCUMENTS 4,239,943 A * 12/1980 Czerwinski ..... H04R 7/16 381/403
5,701,358 A * 12/1997 Larsen ..... H04R 9/063 381/400
(Continued)

FOREIGN PATENT DOCUMENTS

CN 204217122 U 3/2015
CN 204231663 U 3/2015
(Continued)

OTHER PUBLICATIONS

International Search Report, State Intellectual Property Office of the P.R. China, dated Jul. 13, 2016.
(Continued)

*Primary Examiner* — Maria El-Zoobi
*Assistant Examiner* — Julie X Dang
(74) *Attorney, Agent, or Firm* — Holzer Patel Drennan

(57) ABSTRACT

A loudspeaker comprises a housing, a vibration diaphragm, a voice coil assembly, a centering support piece and a magnetic circuit system, an opening is provided at the center of the vibration diaphragm, and the voice coil assembly is fixed at the opening and is suspended in the housing; the magnetic circuit system comprises a magnetic conductive yoke fixedly connected with the housing, a magnet at one side of the magnetic conductive yoke close to the voice coil assembly, and a washer at one side of the magnet away from the magnetic conductive yoke; and a holder for supporting the centering support piece is provided on the washer, and the centering support piece is bonded and fixed to the inner wall of the voice coil assembly. By utilizing the present invention, the height of the loudspeaker can be effectively reduced, and the acoustic performance of the product can be increased.

7 Claims, 2 Drawing Sheets

(58) Field of Classification Search
CPC ..... H04R 31/006; H04R 7/045; H04R 7/12; H04R 9/04; H04R 9/043; H04R 1/06; H04R 1/30; H04R 1/323; G02B 26/085; G02B 7/1821; G10K 11/02; G10K 11/26
USPC ..... 381/412, 430, 389, 400, 423, 181, 401, 381/186; 181/156, 157, 159, 160
See application file for complete search history.

(56) References Cited

U.S. PATENT DOCUMENTS

| | | | | |
|---|---|---|---|---|
| 6,069,965 | A | 5/2000 | Takewa et al. | |
| 2009/0060253 | A1* | 3/2009 | Imamura | H04R 9/06 381/407 |
| 2009/0202100 | A1 | 8/2009 | Iino et al. | |
| 2015/0117698 | A1* | 4/2015 | Bullimore | H04R 7/16 381/398 |

FOREIGN PATENT DOCUMENTS

| | | | |
|---|---|---|---|
| CN | 104822115 | A | 8/2015 |
| CN | 104837097 | A | 8/2015 |
| CN | 204559876 | U | 8/2015 |
| CN | 204559877 | U | 8/2015 |
| CN | 204707227 | U | 10/2015 |
| CN | 205123983 | U | 3/2016 |

OTHER PUBLICATIONS

Office Action, 201510677242.9, State Intellectual Property Office of the P.R. China, dated Oct. 31, 2017.
Office Action, 201510677242.9, State Intellectual Property Office of the P.R. China, dated Jun. 13, 2018.

* cited by examiner

LOUDSPEAKER

TECHNICAL FIELD

The present invention relates to the technical field of acoustic-electric conversion, and more particularly, relates to a loudspeaker.

BACKGROUND

As a common acoustic-electric conversion component that converts electric energy into acoustic energy, the loudspeaker plays an indispensable role in the acoustic system. In our ordinary lives, the most widely used loudspeaker is an electric loudspeaker, which is also referred as moving-coil loudspeaker, which is mainly composed of three portions i.e., a vibration system, a magnetic circuit system and an auxiliary system. Wherein, the vibration system comprises a vibration diaphragm, a voice coil, a centering support piece and the like. The magnetic circuit system comprises a magnet, a washer and a magnetic conductive yoke and the like. The auxiliary system comprises a front cover, a housing, a lead-out wire and the like. In the existing moving-coil loudspeaker, especially in the speaker, the sounding diaphragm is usually composed of a rim and a cone made of a paper material or a fiber material. A voice coil bobbin connected with the cone and suspended in the magnetic field is provided in the speaker, and the voice coil bobbin generates vibration by the electromagnetic induction effect so as to bring the vibration diaphragm to vibrate to generate sound.

In normal conditions, an adhesive is uniformly coated at the connection portions between the cone of the loudspeaker and the voice coil bobbin, and the cone of the loudspeaker and the voice coil bobbin are fixedly connected by the adhesive, such that the cone suspends the voice coil bobbin in the loudspeaker, and the vibration of the voice coil bobbin will bring the cone to vibrate so as to generate sound. In addition, the centering support piece for stabilizing the voice coil is mainly adhered to the outer side of the voice coil, that is to say, the center hole of the centering support piece is adhered onto the voice coil, and the outer diameter of the centering support piece is adhered to the cone, which results to a larger size of the loudspeaker.

With the continuous development of the loudspeaker technology, people have raised higher requirements on the size and the performance of the loudspeaker. The drawbacks existed in the fixing form of the traditional centering support piece affect the improvement for the performance of the loudspeaker. On the one hand, it makes the overall height of the loudspeaker become higher, which is adverse to the miniaturization of the product. On the other hand, the lead wire of the voice coil easily strikes the centering support piece under a high power, which makes the sound quality of the loudspeaker generate distortion, so that the user's high-quality requirement on the loudspeaker cannot be met.

SUMMARY

In view of the above problems, the purpose of the present invention is to provide a loudspeaker to solve the problems of the existing loudspeaker structure, such as a large size of the loudspeaker, the lead wire of the voice coil easily striking the centering support piece, which affect the appearance and the acoustic performance of the loudspeaker.

According to the present invention, there is provided a loudspeaker comprising a housing, a vibration diaphragm, a voice coil, a centering support piece and a magnetic circuit system. Wherein the vibration diaphragm is fixed to the housing, and an opening is provided at the center of the vibration diaphragm, and the voice coil is fixed at the opening of the vibration diaphragm and is suspended in the housing; the magnetic circuit system comprises a magnetic conductive yoke fixedly connected with the housing, a magnet located at a side of the magnetic conductive yoke close to the voice coil, and a washer located at a side of the magnet away from the magnetic conductive yoke; a holder for supporting the centering support piece is provided on the washer, and the centering support piece is adhered and fixed to an inner wall of the voice coil assembly.

In addition, a preferred technical solution is that the centering support piece has an annular wave-shaped structure provided with a central hole, and an inner edge of the centering support piece is fixed to the holder, and an outer edge of the centering support piece is adhered to the inner wall of the voice coil assembly.

In addition, a preferred technical solution is that the voice coil assembly comprises a voice coil and a voice coil bobbin, and the outer edge of the centering support piece is adhered and fixed to an inner wall of the voice coil bobbin.

In addition, the preferred technical solution is that the inner wall of the voice coil bobbin is affixed with a sticker which is made of kraft paper, xuanhua paper, asbestos paper or aramid fiber, and the centering support piece is adhered and fixed to the inner wall of the voice coil assembly through the sticker.

In addition, a preferred technical solution is that the vibration diaphragm comprises a rim and a cone, and an outer edge of the rim is adhered and fixed to the housing, and an inner edge of the rim is adhered and fixed to an upper edge of the cone; and the voice coil is adhered and fixed to a lower edge of the cone.

In addition, a preferred technical solution is that the loudspeaker further comprises a dust cover, wherein an opening is formed at an inner edge of the cone, and the dust cover is fixed at the opening of the vibration diaphragm and is adhered and fixed to the cone of the vibration diaphragm.

In addition, a preferred technical solution is that the magnet and the washer are accommodated in a cavity defined by the magnetic conductive yoke and the housing; a magnetic gap is formed between the magnet along with the washer and the magnetic conductive yoke, and the voice coil is suspended and arranged in the magnetic gap.

In addition, a preferred technical solution is that the voice coil assembly comprises a lead wire of the voice coil, and the loudspeaker comprises a wiring board which is fixed to the housing and electrically connected with the lead wire of the voice coil.

With the loudspeaker according to the present invention, there are the following advantages.

1. The centering support piece is adhered to the inner wall of the voice coil bobbin, which can effectively reduce the height of the loudspeaker product and will benefit the thin type of the product.
2. A circle of sticker is affixed on the inner wall of the voice coil bobbin and the outer edge of the centering support piece is adhered to the sticker, so that the fastness for adhering the centering support piece to the voice coil bobbin can be ensured, and the phenomenon that the lead wire of the voice coil strikes the centering support piece under a high power can be avoided.
3. A holder is installed on the upper surface of the washer to provide a platform for installing and fixing the centering support piece, so as to ensure the stability of the centering support piece and the stability of the product's acoustic performance.

In order to achieve the above and related purposes, one or more aspects of the present invention comprise the features that will be described below in detail and particularly set forth in claims. The following description and the drawings illustrate in detail certain illustrative aspects of the present invention. However, these aspects are merely some of the various ways in which the principles of the present invention can be employed. In addition, the present invention is intended to comprise all such aspects and their equivalents.

BRIEF DESCRIPTION OF DRAWINGS

The other purposes and results of the present invention will become more clear and easy to be understood through the following descriptions in connection with the accompanying drawings and the contents of claims, along with a full understanding of the present invention. In the drawings:

Figure 1:
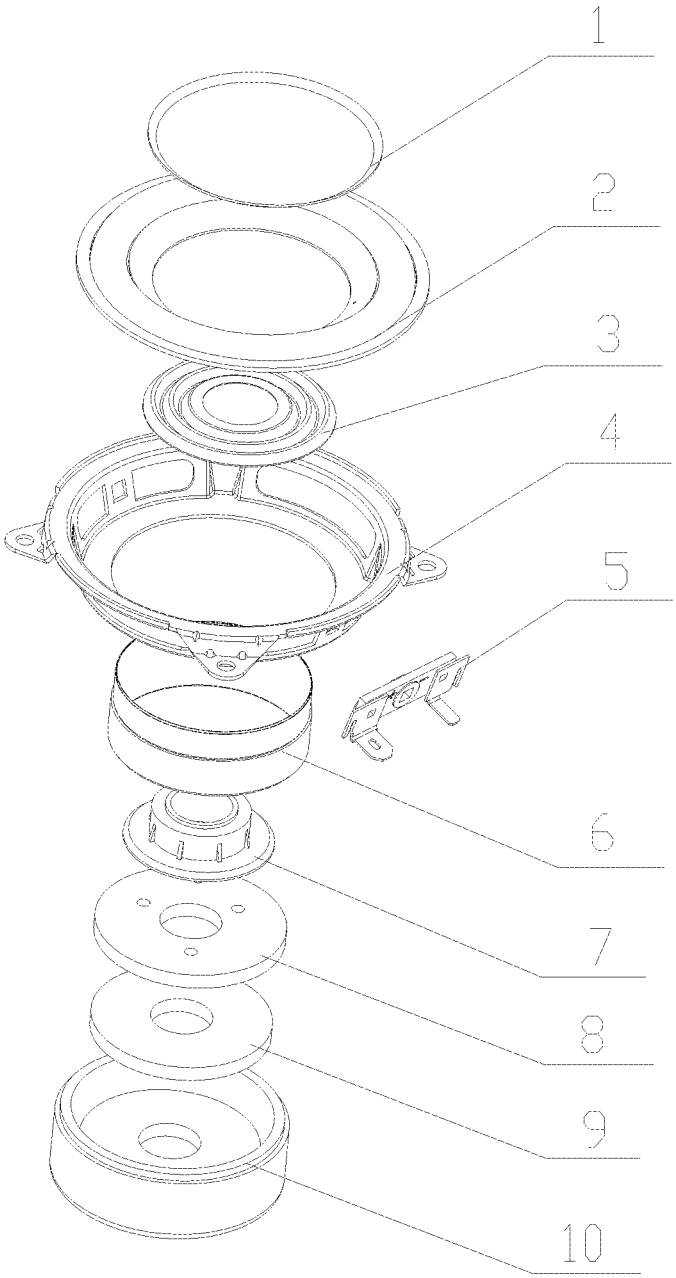
FIG. 1 is a schematic diagram of an exploded structure of a loudspeaker according to an embodiment of the present invention.

The reference numerals in the drawings comprise a dust cover 1, a vibration diaphragm 2, a rim 21, a cone 22, a centering support piece 3, a housing 4, a wiring board 5, a voice coil assembly 6, a holder 7, a washer 8, a magnet 9, a magnetic conductive yoke 10.

The same reference numbers in all of the drawings indicate similar or corresponding features or functions.

DETAILED DESCRIPTION

In the following description, for the purposes of illustration, numerous specific details are explained in order to provide a thorough understanding of one or more embodiments. However, it is apparent that these embodiments can be implemented without these specific details. In other examples, well-known structures and apparatus are illustrated in the form of block diagram in order to facilitate describing one or more embodiments.

For the problems that the central hole of the centering support piece is adhered to the outer side of the voice coil, a large size of the product due to the outer edge of the centering support piece fixing on the housing, an unstable acoustic performance of the product due to the lead wire of the voice coil easily striking the damper (i.e., the centering support piece), in the present invention, the central hole (or the inner edge) of the centering support piece is fixed to the holder, and the outer edge of the centering support piece is fixed to the inner wall of the voice coil assembly, which can effectively reduce the height of the loudspeaker and make it easy to achieve ultra-thin loudspeakers, meanwhile can avoid the phenomenon that the lead wire of the voice coil strikes the damper under a high power and ensure small size and stability acoustic performance of the product.

In order to describe the loudspeaker of the present invention in detail, the particular embodiments of the present invention will be described in detail in combination with the accompanying drawings in the following.

Figure 2:
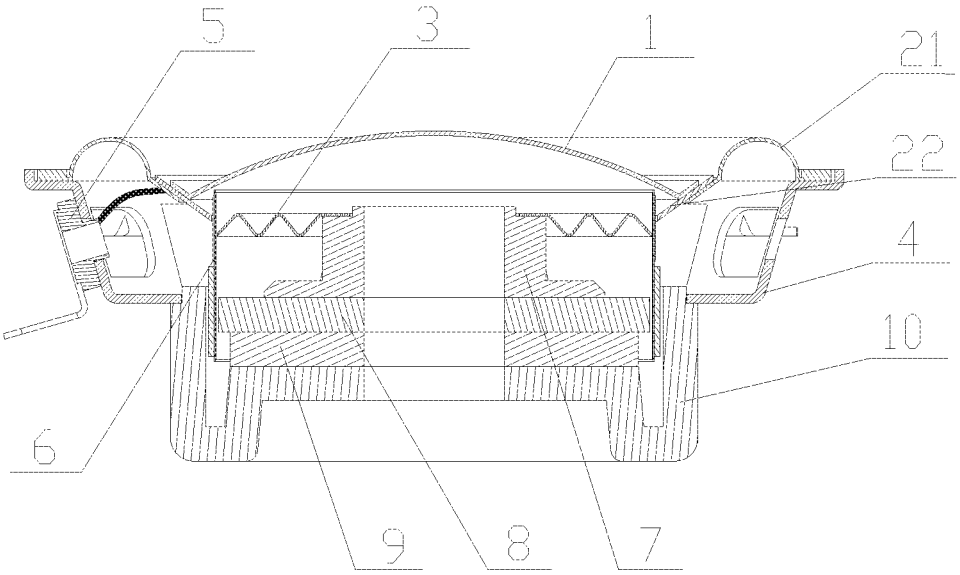
FIG. 2 is a schematic diagram of a sectional structure of a loudspeaker according to an embodiment of the present invention.

FIG. 1 shows an exploded structure of a loudspeaker according to an embodiment of the present invention; and FIG. 2 shows a sectional structure of a loudspeaker according to an embodiment of the present invention.

As shown in FIG. 1 and FIG. 2 together, the loudspeaker according to the embodiment of the present invention comprises a housing 4 having a basin structure, a vibration diaphragm 2, a voice coil assembly 6 fixedly connected with the vibration diaphragm 2, a centering support piece 3 and a magnetic circuit system; wherein the vibration diaphragm 2 is fixed on the housing 4, and an opening is provided in the center of the vibration diaphragm 2, and the voice coil assembly 6 is fixed at the opening of the vibration diaphragm and is suspended in the housing 4; the magnetic circuit system comprises a magnetic conductive yoke 10 fixedly connected with the housing 4, a magnet 9 located at a side of the magnetic conductive yoke 10 which is close to the voice coil assembly 6, and a washer 8 located at a side of the magnet 9 which is away from the magnetic conductive yoke 10; a centering support piece 3 is disposed inside the voice coil assembly 6, and a holder 7 for supporting the centering support piece 3 is provided on the washer 8, and the voice coil assembly 6 comprises a voice coil and a voice coil bobbin, and a sticker is affixed on an inner wall of the voice coil bobbin, and the centering support piece 3 is adhered and fixed to the inner wall of the voice coil bobbin by the sticker.

In particular, the vibration diaphragm 2 comprises a rim 21 and a cone 22 both of which having an annular structure. The outer edge of the rim 21 is adhered and fixed with the housing 4, and the inner edge of the rim 21 is adhered and fixed with the upper edge of the cone 22, and the lower edge of the cone 22 forms the center opening of the vibration diaphragm 2; the voice coil assembly 6 is adhered and fixed with the lower edge (or the opening) of the cone 22 and suspended in the housing 4. Wherein, the rim 21 may be adhered and fixed with the housing 4 and the cone 22 respectively, and other fixing methods may be selected according to the materials of the vibration diaphragm 2 and the housing 4.

Wherein, the cone 22, which is the main sounding device, can be made of metal material in this embodiment. The rim 21, which is a suspended connection component, should have sufficient strength and toughness and provide the cone 22 and the voice coil assembly 6 with sufficient vibration amplitude. Therefore, the rim 21 can be made of rubber, high molecular polymer material, or the rim 21 can be made of metal material for further improving heat dissipation and sound quality. The rim 21 and the cone 22 need to be closely connected to each other, thus different materials for manufacturing the rim 21 are selected according to actual needs.

As shown in FIG. 2, the magnetic circuit system in the embodiment of the present invention comprises the magnetic conductive yoke 10 fixedly connected with the housing 4, the magnet 9 located at a side of the magnetic conductive yoke 10 close to the voice coil assembly 6, and the washer 8 located at a side of the magnet 9 away from the magnetic conductive yoke 10; wherein the magnetic conductive yoke 10 can adopt a U-shaped iron with a hollow basin structure, and the magnetic conductive yoke 10 and the housing 4 form a cavity for accommodating the vibration system (comprising the voice coil assembly 6 and the vibration diaphragm) and the magnetic circuit system; that is to say, the magnet 9 and the washer 8 are accommodated in the cavity formed by the magnetic conductive yoke 10 and the housing 4, and the magnet 9 and the washer 8 form a magnetic gap with the sidewall of the magnetic conductive yoke 10, and the voice coil assembly 6 and the vibration diaphragm are fixed, then are suspended and arranged in the magnetic gap, the voice coil assembly 6 generates vibration through the electromagnetic effect, thereby drives the diaphragm vibration to vibrate and generate sound.

In other words, in the embodiment of the present invention, the magnetic circuit system may comprise the magnetic conductive yoke 10, the magnet 9 and the washer 8. As shown in FIG. 1 and FIG. 2 together, the bottom surface of the magnetic conductive yoke 10 is circular, and the upper end of the side wall of the magnetic conductive yoke 10 is mounted at the housing 4, and the magnetic conductive yoke 10 and the housing 4 are combined to form the basic shape of the loudspeaker device. A central magnetic circuit is mounted inside the magnetic conductive yoke 10, and the central magnetic circuit comprises the magnet 9 and the washer 8 in order from top to bottom, and a gap (magnetic gap) exists between the central magnetic circuit and the side wall of the magnetic conductive yoke 10, such that a uniform magnetic field is generated between the central magnetic circuit and the side wall of the magnetic conductive yoke 10, and the lower part of the voice coil bobbin of the voice coil assembly 6 extends into the magnetic gap and is located in the uniform magnetic field.

Wherein, a holder 7 for supporting the centering support piece 3 is provided on the upper side (i.e., the side which is far away from the magnetic conductive yoke 10) of the washer 8, and the inner edge of the voice coil assembly 6 is adhered to the holder 7. Specifically, the centering support piece 3 in the present invention may be configured into an annular wave-shaped structure with a central hole, and is used for stabilizing the vibration state of the voice coil assembly 6 such that the voice coil assembly 6 is steadily vibrated in a direction perpendicular to the magnetic field, and the centering support piece 3 comprises an inner edge (forming the central hole of the centering support piece 3) and an outer edge. The centering support piece 3 is arranged inside the voice coil assembly 6, and the inner edge of the centering support piece 3 is fixed on the holder 7, and the outer edge of the centering support piece 3 is adhered to the inner wall of the voice coil bobbin. The centering support piece 3 is arranged inside the voice coil assembly 6, which can effectively reduce the height of the loudspeaker product and achieve thin development of loudspeaker product.

In addition, the magnetic conductive yoke 10, the magnet 9, the washer 8 and the holder 7 are provided with central through holes which positioned corresponding to each other up and down, and the central through holes are used as the sound hole for the rear acoustic cavity of the loudspeaker.

It should be noted that, the voice coil assembly 6 according to the present invention comprises a lead wire of the voice coil, which is used for connecting with an external circuit. Since the voice coil bobbin is generally made of aluminum or plastic and the like so that the surface thereof is relatively smooth, if the centering support piece 3 is directly fixed with the voice coil bobbin, the bonding strength is relatively low, which easily leads to the slipping of the centering support piece 3. Therefore, in the loudspeaker structure of the present invention, a layer of sticker is affixed to the inner wall of the voice coil bobbin so as to adhere and fix the centering support piece 3 with the sticker, thereby enhancing the bonding strength between the centering support piece 3 and the voice coil. Wherein, the sticker can adopt kraft paper, xuanhua paper, asbestos paper or aramid fiber and the like, and other materials which can achieve a secure bonding between the centering support piece 3 and the voice coil.

In another embodiment of the present invention, the loudspeaker further comprises a dust cover 1 which is adhered and fixed with the cone 22 of the vibration diaphragm. The dust cover 1 may be an arc-shaped structure. In order to achieve a better acoustic effect, the dust cover 1 can be made of the same material as the vibration diaphragm. Since the inner edge of the cone 22 forms an opening and the dust cover 1 is fixed at the opening of the vibration diaphragm, it is possible to prevent foreign matters, dust and the like from falling onto the voice coil assembly 6 and falling into the housing 4, and to avoid affecting the loudspeaker's acoustic performance. In addition, the dust cover 1 also can completely isolate the upper side of the vibration diaphragm 2 from the lower side of the vibration diaphragm 2 to prevent the acoustic short circuit phenomenon.

In addition, the loudspeaker according to the embodiment of the present invention may further comprise a wiring board 5. The wiring board 5 is fixed on the housing 4 and used for fixing the lead wire of the voice coil and connecting the lead wire of the voice coil with the external circuit, wherein the wiring board 5 is fixed at the side surface of the housing 4, and the end of the lead wire of the voice coil is inserted in the wiring board 5 or welded to the wiring board 5, and the external sound signal cable can also be inserted in the wiring board 5 to be directly connected to the lead wire of the voice coil.

By using the loudspeaker of the present invention, the inner edge of the centering support piece is fixed on the holder, the outer edge of the centering support piece is fixed on the inner wall of the voice coil bobbin, thus the height of the loudspeaker can be effectively reduced and a ultra-thin speaker can be easily achieved; In addition, a circle of sticker is affixed on the inner wall of the voice coil bobbin and the outer edge of the centering support piece is adhered on the sticker, thereby can ensure the fastness for adhering the centering support piece to the voice coil bobbin, and prevent the lead wire of the voice coil from striking the centering support piece under a high power so as to ensure the stability of the loudspeaker product's acoustic performance.

The loudspeaker according to the present invention is described by way of example with reference to the accompanying drawings. However, those skilled in the art should understand that various modifications may be made to the loudspeaker according to the present invention without departing from the scope of the present invention. Therefore, the protection scope of the present invention should be determined by the contents of the appended claims.

What is claimed is:

1. A loudspeaker comprising a housing, a vibration diaphragm, a voice coil assembly, a centering support piece and a magnetic circuit system, wherein:

the vibration diaphragm is fixed to the housing, an opening is provided at a center of the vibration diaphragm, and the voice coil assembly is fixed at the opening of the vibration diaphragm and is suspended in the housing;

the magnetic circuit system comprises a magnetic conductive yoke fixedly connected with the housing, a magnet located at a side of the magnetic conductive yoke close to the voice coil assembly, and a washer located at a side of the magnet away from the magnetic conductive yoke;

a holder for supporting the centering support piece on the washer, the centering support piece connected and fixed to an inner wall of the voice coil assembly and the centering support piece arranged inside the voice coil assembly; and the centering support piece has an annular wave-shaped structure with a central hole, an inner edge of the centering support piece fixed to the holder, and an outer edge of the centering support piece connected to the inner wall of the voice coil assembly.

2. The loudspeaker according to claim 1, wherein the voice coil assembly comprises a voice coil and a voice coil bobbin, and an outer edge of the centering support piece is connected and fixed to an inner wall of the voice coil bobbin.

3. The loudspeaker according to claim 2, wherein the inner wall of the voice coil bobbin is affixed with a sticker which is made of kraft paper, xuanhua paper, asbestos paper or aramid fiber, and the centering support piece is connected and fixed to the inner wall of the voice coil assembly through the sticker.

4. The loudspeaker according to claim 2, wherein the magnet and the washer are accommodated in a cavity defined by the magnetic conductive yoke and the housing; and a magnetic gap is formed between the magnet along with the washer and the magnetic conductive yoke, and the voice coil is suspended and arranged in the magnetic gap.

5. The loudspeaker according to claim 3, wherein the voice coil bobbin comprises a lead wire of the voice coil, and the loudspeaker comprises a wiring board which is fixed to the housing and electrically connected with the lead wire of the voice coil.

6. The loudspeaker according to claim 1, wherein the vibration diaphragm comprises a rim and a cone, and an outer edge of the rim is connected and fixed to the housing, and an inner edge of the rim is connected and fixed to an upper edge of the cone; and the voice coil is connected and fixed to a lower edge of the cone.

7. The loudspeaker according to claim 6, further comprising a dust cover, wherein an opening is formed at an inner edge of the cone, and the dust cover is fixed at the opening of the vibration diaphragm and is connected and fixed to the cone of the vibration diaphragm.

* * * * *